United States Patent [19]

Vosberg

[11] 3,985,353

[45] Oct. 12, 1976

[54] PHYSICAL AND MENTAL DEVELOPMENT JUMP SET

[76] Inventor: Donald T. Vosberg, 3625 E. Flower, Apartment E, Tucson, Ariz. 85716

[22] Filed: July 1, 1975

[21] Appl. No.: 592,325

[52] U.S. Cl. ..... 272/102

[51] Int. Cl.[2] ..... A63B 5/02

[58] Field of Search ..... 272/59 C, 59 R, 101, 272/102, 103; 35/35 H, 29 R, 29 B; 40/125 H, 11 R, 13, 128

[56] References Cited

UNITED STATES PATENTS

| | | | |
|---|---|---|---|
| 609,823 | 8/1898 | Love | 40/128 |
| 1,602,341 | 10/1926 | Day | 40/11 R |
| 3,119,588 | 1/1964 | Keats | 272/59 C |
| 3,366,381 | 1/1968 | Ross | 272/59 C |
| 3,373,450 | 3/1968 | Brooks | 35/29 B |
| 3,848,467 | 11/1974 | Flavell | 35/29 R |

FOREIGN PATENTS OR APPLICATIONS

| | | | |
|---|---|---|---|
| 819,145 | 8/1959 | United Kingdom | 272/59 C |
| 746,740 | 3/1956 | United Kingdom | 272/59 C |

OTHER PUBLICATIONS

Medazt Catalog L-3, Received in PTO 1/18/1926, p. 61.

*Primary Examiner*—Jerome Schnall
*Attorney, Agent, or Firm*—Clarence A. O'Brien; Harvey B. Jacobson

[57] ABSTRACT

A set of jumps comprising a plurality of horizontal elongated jump barriers disposed in generally parallel laterally spaced and aligned position is provided. The opposite end portions of the jump barriers include depending support legs and the upper ends of the support legs are removably telescoped into downwardly opening sockets at the opposite ends of the barriers. The lower ends of the legs are curved and merge smoothly into horizontally directed integral foot portions for support of the legs from a horizontal surface. The legs comprise tubular members and the effective vertical extent of the legs of at least one of the jump barriers differs from the effective vertical extent of the legs of at least one other jump barrier. Also, the barriers include corresponding longitudinal side faces each having a plurality of longitudinally extending zones of different light reflecting properties spaced longitudinally therealong and each of the barriers includes a releasable clamp structure supported therefrom for each zone with the clamp structures being operative to releasably support strip members therefrom in overlying relation relative to the corresponding zone of the barrier side surface.

3 Claims, 4 Drawing Figures

CAT
WHITE
PUPPY

PHYSICAL AND MENTAL DEVELOPMENT JUMP SET

BACKGROUND OF THE INVENTION

Although various structures for the development of the physical and mental properties of growing children have been heretofore designed it has been found that a need exists for mental and physical development equipment specifically tailored for use by children in the elementary and junior high school age bracket.

The jump set of the instant invention comprises a set of plurality of specifically designed hurdles which may be used not only as hurdles but also as barriers to lay out a prescribed course of movement. While there are various forms of hurdles and barriers which have been previously constructed, most of these previous structures are usable only for a single purpose or for but a few selected purposes. Examples of previously patented devices including some of the basic structural features of the instant invention are disclosed in U.S. Pat. Nos. 1,910,080, 2,458,984, 2,685,140, 2,706,631 and 3,024,022.

BRIEF DESCRIPTION OF THE INVENTION

The jump set includes a plurality of horizontal barriers equipped with three longitudinally spaced zones of different light reflecting properties and each barrier is provided with opposite end depending legs which may be readily shifted between operative extending positions and retracted positions for ease and storage.

The main object of this invention is to provide a set of jump barriers specifically deisgned to encourage physical and mental development of elementary and junior high school aged children.

Another object of this invention is to provide a set of elevated barriers constructed in a manner whereby they may be used as jumps to be jumped over or as obstacles to be crawled under or run around.

yet another object of this invention is to provide a set of jump barriers including three longitudinally extending and spaced zones of different light reflecting properties.

Another object of this invention is to provide a horizontal barrier in accordance with the immediately preceding object and including releasable clamp structures for the various zones of different light reflecting properties thereof with the clamp structures being adapted to removably support card strips therefrom.

Another important object of this invention is to provide a set of jump barriers in accordance with the immediately two preceding objects and which may be utilized to provide additional mental stimulation in conjunction with physical activity, based on sound educational learning theory.

Yet another object of this invention is to provide a series of jump barriers that provides for progressive running steps drill.

Another important object of this invention is to provide a series of barriers that may be readily used inside a building structure as well as outside.

Yet another important object of this invention is to provide a plurality of jump barriers that may be readily transformed into objects having physical characteristics enabling them to be readily transported and stored.

A final object of this invention to be specifically enumerated herein is to provide a set of jump barriers in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figures 1, 2, 3, 4:
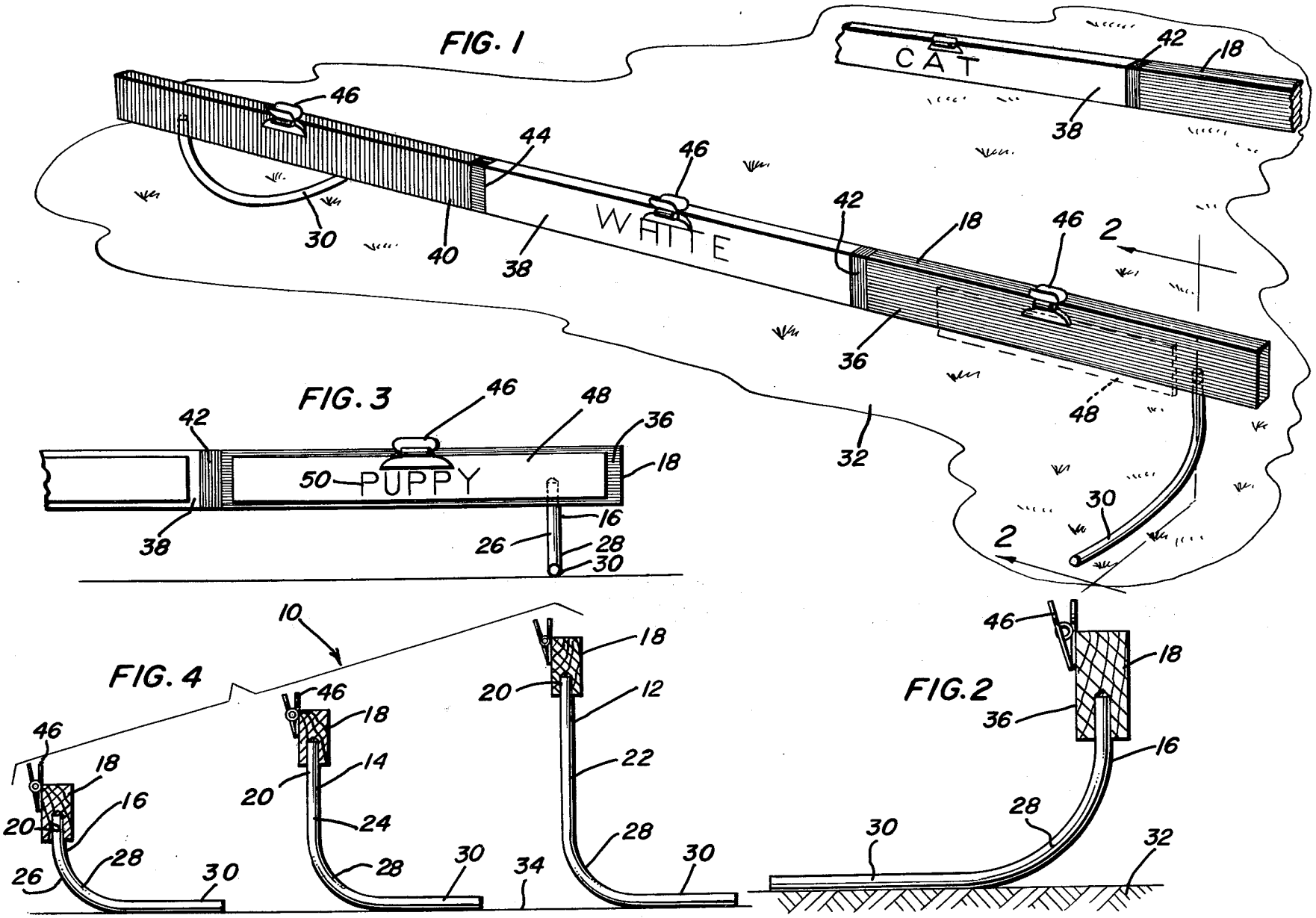
FIG. 1 is a fragmentary perspective view of a plurality of jump barriers constructed in accordance with the present invention and positioned on the ground to be utilized as a series of jump barriers.
FIG. 2 is an enlarged vertical sectional view taken substantially upon the plane indicated by the section line 2—2 of FIG. 1.
FIG. 3 is a fragmentary front elevational view of a jump barrier constructed in accordance with the present invention illustrating the manner in which various selected sign strips may be removably supported from longitudinally spaced zones of the horizontal barriers.
FIG. 4 is a vertical sectional view similar to FIG. 2 but with a plurality of jump barriers disposed in laterally spaced relation to comprise high step-over barriers of progressively increasing height.

Referring now more specificallly to the drawings the numeral 10 generally designates a set of three barrier assemblies 12, 14 and 16. Each barrier assembly comprises an upper horizontal barrier member 18 which may be in the form of a conventional two by four disposed on one longitudinal edge. Each of the barrier members 18 includes a pair of opposite end downwardly opening blind bores 20 and the barrier assembly 12 includes a pair of legs 22 while the barrier assembly 14 includes a pair of legs 24 and the barrier assembly 16 includes a pair of legs 26. The legs 22 have an effective vertical extent of 12 inches and the legs 24 of the barrier assembly 14 have an effective vertical extent of 10 inches while the legs 26 of the barrier assembly 16 have an effective vertical extent of 6 inches.

The blind bores 20 are approximately one-half inch in diameter and each of the legs 22, 24 and 26 comprises a tubular member having an outside diameter of approximately one-half inch. The upper ends of each of the legs 22, 24 and 26 are removably rotatably telescoped in the corresponding blind bore 20 and the lower end of each leg 22, 24 and 26 includes an integral curved portion 28 of 90 degree extent which merges smoothly into an integral horizontally directed foot portion 30. From FIGS. 1 and 4 of the drawings it may be seen that the foot portions 30 may be utilized to support the corresponding barrier member from the ground 32 or from an interior building floor surface 34. Thus, the barrier assemblies may either be used outside or inside a building structure.

With attention now invited more specifically to FIG. 1 of the drawings it may be seen that each barrier member 18 includes three longitudinally extending and longitudinally spaced zones 36, 38 and 40 of different light reflecting properties. The zones 36 are blue in color, the zones 38 are white in color and the zones 40 are red in color. In addition, a red band 42 separates zones 36 and 38 and a blue band 44 separates the white and red zones 38 and 40. Further, each portion of the barrier member 18 represented by the zones 36, 38 and 40 is provided with a spring clamp structure 46 by which a strip member 48 may be supported in overlying relation to one side of the corresponding zones, each strip member 48 including a different series of indicia 50.

With attention invited to FIG. 1 of the drawings it will be noted that the foot portions 30 of the legs of each barrier member 18 extend in opposite directions when the barrier is in use. However, when it is desired to transport a plurality of the barriers over a short distance, the legs thereof may be rotated into positions coplanar with the barrier members 18 for ease in transport. In addition, if the barrier assemblies are to be stored for any length of time, the legs 22, 24 and 26 may be removed from engagement in the blind bores 20.

In use, the barrier assemblies may be utilized in sets of a plurality of barrier assemblies and the barrier members 18 thereof may be alternately reversed end to end in order that a child to jump over the barrier assemblies may be instructed to jump over only a specific color zone of the barriers. Further, the strips 48 with the indicia 50 thereon may also be used to designate specified areas of the barrier members.

Inasmuch as the foot portions 30 carried by the legs at opposite ends of each barrier member 18 are normally oppositely directed when the barrier member 18 is in use, the foot portions of the barrier members to be jumped over may be positioned in the same direction opposite to the direction of movement of the child so that the barrier members may readily fall over when hit by a younger child. Further, the barrier members may have the foot portions thereof oppositely directed if the barrier members are to be crawled under and greater stability of the end portions of the barrier members to be crawled under is desired.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A physical and mental development jump set for children, said set comprising a plurality of horizontal elongated jump barriers disposed in generally parallel laterally spaced and aligned position, the opposite end portions of said jump barriers including depending support legs whose lower ends are equipped with foot portions adapted for support from a horizontal support surface, the opposite end portions of said jump barriers including means defining downwardly opening sockets, the upper ends of said legs being telescopingly and rotatably received in said sockets for angular displacement relative to the corresponding barriers about axes generally coinciding with the longitudinal center lines of said upper end portions, said foot portion comprising lower end longitudinally directed integral terminal ends of said legs, the lower end portions of said legs comprising curved sections smoothly merging into said horizontally directed terminal ends, the effective vertical extent of the legs of one of said jump barriers being different from the effective vertical extent of the legs of at least one other jump barrier of said set of jump barriers, the greatest effective vertical extent of the legs being approximately 1 foot, said barriers including corresponding longitudinal side faces each including at least three horizontally elongated longitudinally extending zones of different light reflecting properties spaced longitudinally therealong and on opposite side faces of each barrier, the total length of said zones on each barrier being at least substantially equal to the length of that barrier and said barriers being selectively reversible end to end, with the lower horizontally directed terminal ends of the legs of all of the barriers projecting in the same horizontal direction upon 180 degree angular displacement of the upper ends of the legs of the reversed barriers relative to the corresponding sockets, whereby the various zones of different light reflecting properties of said barriers may be alternately varied in position along said barriers for the purpose of requiring a jumper to jump over alternately positioned predetermined longitudinal zones of similar light reflecting properties of successful barriers.

2. The combination of claim 1 wherein said legs comprise tubular members.

3. The combination of claim 1 wherein each of said barriers includes releasable clamp means supported therefrom with one clamp means for each of the corresponding zones of the side face thereof, each of said clamp means including means for releasably supporting a strip member therefrom in overlying relation relative to the corresponding zone of said side surface.

* * * * *